United States Patent [19]

Ingermann et al.

[11] Patent Number: 4,510,642

[45] Date of Patent: Apr. 16, 1985

[54] COMBINATION BOWLING LANE STRIPPER AND DUSTER

[75] Inventors: Donald E. Ingermann, Arvada; Ronald L. Smith, Boulder; Jimmie L. Knoll; Stephen F. Caffrey, both of Arvada; Endre Barsi, Northglenn; Joseph C. Dechant, Aurora, all of Colo.

[73] Assignee: Century International Corp., Golden, Colo.

[21] Appl. No.: 563,074

[22] Filed: Dec. 19, 1983

[51] Int. Cl.[3] ..... A47L 13/20

[52] U.S. Cl. ..... 15/231; 15/99; 15/228

[58] Field of Search ..... 15/98, 99, 228, 230.18, 15/231–233; 51/403, 174

[56] References Cited

U.S. PATENT DOCUMENTS

| | | | |
|---|---|---|---|
| 2,394,585 | 2/1946 | Bailey | 15/231 X |
| 2,601,537 | 6/1952 | Lofgren | 15/231 X |
| 2,690,582 | 10/1954 | Sundell | 15/231 X |
| 2,810,149 | 10/1957 | Guelker | 15/231 |
| 2,828,501 | 4/1958 | Brown, Sr. | 15/231 X |
| 3,116,504 | 1/1964 | Unterbrink et al. | 15/231 |
| 3,150,407 | 9/1964 | Mitchell | 15/98 X |
| 3,428,986 | 2/1969 | Rudolph | 15/99 |
| 4,121,315 | 10/1978 | Buser | 15/228 |

*Primary Examiner*—Edward L. Roberts

*Attorney, Agent, or Firm*—Edwin L. Spangler, Jr.

[57] ABSTRACT

This invention relates to a manual bowling lane stripping and dusting apparatus characterized by a frame journalling three rollers spaced one behind the other for independent relative rotation in parallel relation, the rear roller comprising a clutched supply roller for holding a supply of bowling lane dusting cloths, the front roller consisting of a ratcheted take-up roller for storing the soiled toweling or cloth dispensed from the supply roller, and an intermediate pressure roller offset beneath the other two and equipped with a cushioned surface tapered toward each end for pressing the portion of the cleaning web bridging the gap between the front and rear rollers into continuous area contact with the lane across the full width thereof.

8 Claims, 2 Drawing Figures

COMBINATION BOWLING LANE STRIPPER AND DUSTER

Figure 1:
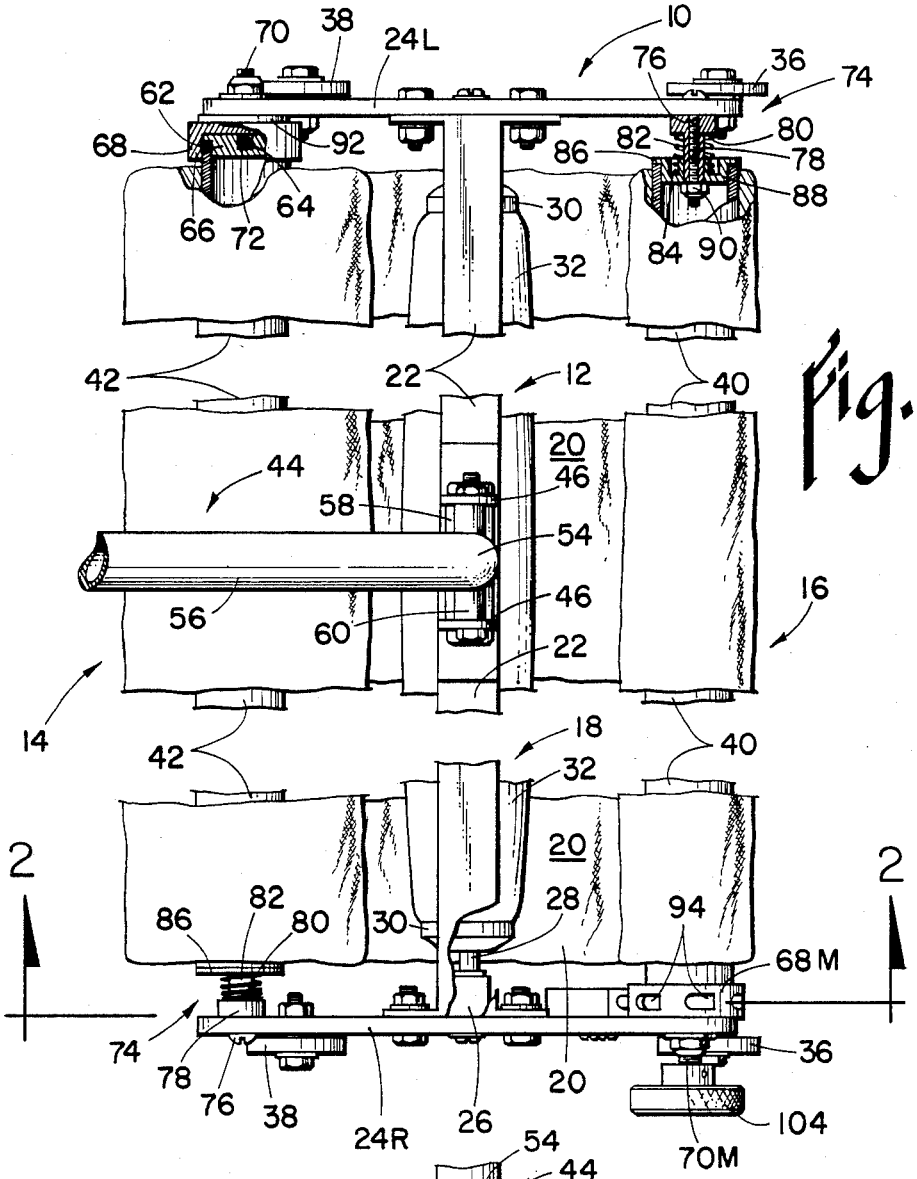

Several motorized bowling lane cleaning, dusting and dressing machines, some completely automatic, are available to the proprietor of a bowling establishment, examples thereof forming the subject matter of U.S. Pat. Nos. 3,150,395; 3,216,036; 3,418,672; 3,787,916; 3,868,738; and 4,246,674; and probably others. These machines along with their manually operated counterparts, mostly all have webs of absorbant material wound on a supply roller and stored on a take-up roller with the portion in between reaved underneath a pressure roller designed to maintain the cloth or other material in continuous contact with the lane surface from edge to edge thereof. Guide wheels are often provided that ride in the ball return gutters to maintain the unit centered on the lane. Of course, the motorized machines have powered buffers, special dispensers for the lane maintenance liquids and sophisticated distance-responsive controls which regulate and change the functions being performed depending upon the location of the unit.

The far simpler manual units ordinarily are not used for dressing or buffing (polishing) the lane surfaces but rather cleaning them. The simplest of the cleaning functions is merely removing dust therefrom by wiping the surface with a clean dry cloth or other suitable material. Removing soil held by the surface dressing, on the other hand, is usually a wet operation requiring water or special solvents. Wet cleaning and dressing of the lanes is customarily done at off-hours when they are not being used, whereas, many "houses" as they are often called, dust the lanes after each three-game series. The cleaning procedures used as well as the materials vary from manufacturer to manufacturer and sometimes from user to user. On the other hand, much of the equipment can be used with various materials and procedures.

The concern here is with the cleaning operation when performed manually. The most pertinent of the prior art units known to applicant is marketed under the trademark "THE KEY" by The Kegel Company of St. Joseph, Missouri. It, in common with many other lane cleaning machines, has a frame journalling for rotating a supply roller, a take-up roller and a pressure roller between the two that cooperate to present a fresh absorbant piece of toweling on a roll thereof to a prewetted lane along which the device is propelled manually. This prior art unit has a number of significant shortcomings which make it difficult as well as unhandy to use. To begin with, both the take-up and supply rolls must be removed from the frame for replacement of a soiled web or roll of cloth. Since the cloth may be several yards long, such an operation becomes rather difficult to perform with the rollers unsupported and suitably journalled in spaced parallel relation, especially if the cloth is to remain wrinkle-free which is essential to proper lane contact. Along this same line, as the unit is disassembled and reassembled in order to change cloths, both the take-up and supply rollers must be individually retightened and adjusted relative to one another to restore the proper web tension.

Secondly, advancing the web to place a fresh run of cloth in contact with the lane surface involves manually grasping the take-up roll and turning it to pull more material off the supply roller. This is not only an unhandy procedure, but one that involves handling the cloth with the possibility of soiling same, transferring oil thereto from the hands and, especially, squeezing it to the point where some of the solvent is displaced leaving a relatively drier area next to an overly wet one.

Finally, and most important, is the fact that the prior art lane cleaning machines, both manual and motorized, have failed to provide a unit that cleans uniformly all the way across. This stems from the fact that, first of all, the long unsupported span of the pressure roller allows it to flex in the middle and thus apply the greater pressure at the ends. Secondly, and by way of compounding the problem, most bowling lanes have a slight across-the-lane concavity after they have been in use for awhile.

It has now been found in accordance with the teaching of the instant invention that these and other shortcomings of the prior art lane-cleaning machines by the simple, yet unobvious, expedient of first providing a pressure roller with a soft-cushioned surface that is larger in the middle and tapers gradually toward each end. Secondly, by providing the supply roller with an adjustable friction clutch the take-up roller with a ratchet-type advance mechanism, and both with spring-loaded release mechanisms, web tension becomes a simple matter to set and maintain even if, for some reason, one or both rollers must be disassembled from the frame. The ratchet-advance on the take-up roller is easily accessible alongside the frame which means that the operator need not step on the lane to advance the web. Moreover, the ratchet automatically latches the web against unwinding off the take-up roller under the influence of the frictional pressure placed thereon as the unit advances along the lane. The friction clutch on the supply roller keeps the proper tension on the web from behind where the operator stands.

It is, therefore, the principal object of the present invention to provide a novel and improved manually-operated bowling lane cleaning apparatus.

A second objective is the provision of a device of the character described in which the web can be replaced while the supply and take-up rollers remain on the frame.

Another object of the invention herein disclosed and claimed is to provide a combination unit which, upon being fitted with the appropriate web, can be used for either dry or wet cleaning.

Still another object is to provide a bowling lane cleaner having a double-tapered cushioned pressure roller specially shaped to conform to cross-lane concavities as well as roller deflection.

An additional object is the provision of a clutched supply roller coacting with a ratcheted take-up roller to maintain a preselected web tension.

Further objects are to provide a cleaning apparatus for bowling lanes that is simple, easy to use, lightweight, versatile, adapted for use with a variety of solvents, and one that can be safely used on a lane without fear of damaging same.

Figure 2:
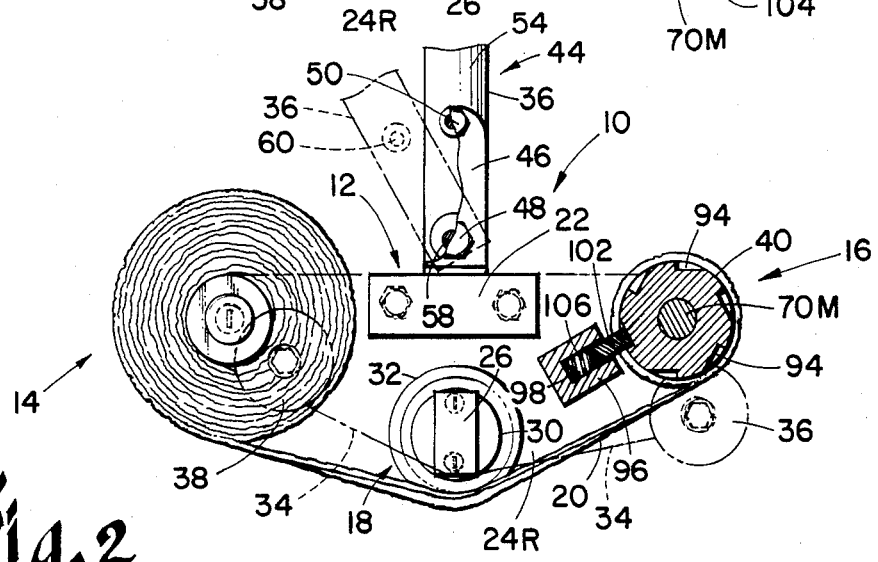

Other objects will be in part apparent and in part pointed out specifically hereinafter in connection with the description of the drawings that follows, and in which:

FIG. 1 is a fragmentary top plan view, substantial portions of which have broken away to conserve space while others have been similarly treated to more clearly reveal the interior construction; and, FIG. 2 is a fragmentary section taken along line 2—2 of FIG. 1 and which also has portions broken away to expose otherwise hidden features.

Referring next to the drawings for a detailed description of the present invention, reference numeral 10 has been chosen to designate the lane-cleaning unit broadly while numeral 12 denotes the frame thereof in a general way. In like manner, numerals 14 and 16 broadly identify the supply and take-up roller subassemblies which numeral 18 does so with respect to the pressure roller. Numeral 20 identifies the web of cloth or other absorbant material reaved between the supply and take-up rollers and underneath the pressure roller.

Frame 12 in the particular form shown, is made up of a crossframe member 22 in the shape of an I-beam to the ends of which are bolted a pair of endplates 24R and 24L. On the inside of the endplates 24 are fastened a pair of small pillowblocks 26 which journal the pressure roller shaft 28 for rotation directly underneath I-beam crossframe member 22 paralleling the latter. Shaft 28 mounts the pressure roller 30, the surface of which is covered by a deformable elastic cushion 32 adapted to yield and conform to minor irregularities in the lane surface. More important than its cushioned surface is the fact that the pressure roller is double-tapered, i.e. tapered from the center toward both ends. In the drawing, this taper has been highly exaggerated for illustrative purposes, it being more like ¼th to ⅜ths inches over a half roller span of some 2 feet or so. Nevertheless, this taper allows the pressure roller to not only keep the web 20 in contact with a concave lane surface throughout the width thereof but also to maintain a relatively constant pressure against the surface thereof despite minor deflection of the roller due to its long (about four feet) unsupported span.

FIG. 2 reveals the fact that the bottom edge 34 of the endplates is truncated both to the front and rear of its midpoint where the pressure roller and crossframe member are located to form an obtuse angle of about 135° although this angle is by no means critical. The pressure roller is positioned at or at least very close to the apex of this angle and low enough in the frame such that the cushioned surface 32 projects well below the lower edge 34 of this endplate thus assuring that the metal cannot contact the lane surface. Pressure roller subassembly 18 cooperates with one or the other of wheel pairs 36 and 38 located, respectively, at the front and rear outside corners of the sideplates to both guide and support the unit 10 during its excursion along the lane. Looking at FIG. 2, the unit will be pushed to the right and, as illustrated, be supported by pressure roller subassembly 18 in the rear and the front pair of guide wheels 36 in the front, the latter running in the ball gutters to keep everything properly aligned. Note, however, that as the portion of the web 20 stretched between the pressure roller subassembly 18 and the take-up roller subassembly 16 becomes soiled and thus moved forward onto take-up roller 40, the diameter of the latter becomes larger while that of the supply roller 42 gets smaller. As this takes place, the entire assembly (except for the handle broadly indicated by numeral 44) will tilt more and more to the rear or in the direction of the operator until take-up roller subassembly 16 becomes so large that it lifts wheels 36 out of the gutters alongside the lane. All this time, however, the supply roller subassembly 14 is getting smaller at the same rate and rear wheels 38 which, as shown in FIG. 2, are inoperative, gradually lower into the gutters and take over the guidance function. While the guidance function shifts from front to rear, the portion of the web in contact with the lane surface does not but remains at all times in front of the pressure roller subassembly.

Returning again to FIGS. 1 and 2, crossframe member 22 will be seen to include a pair of apertured upstanding ears 46 arranged in transversely-spaced parallel relation to one another equidistant on opposite sides of the longitudinal centerline. These ears have a lower pair of transversely-aligned apertures and an upper pair spaced thereabove, neither pair of which has been shown but their position is revealed by handle-mounting bolts 48 and 50, respectively, which pass through the latter. Handle 44 is of a dogleg shape, the lower downturned end 54 of which is detachably secured by one or both of the bolts 48 and 50 between the ears 46 of the frame while the stem 56 thereof extends upwardly and to the rear where it is grasped by the operator. Now, as can be seen most clearly in FIG. 2, the downturned end 54 of the handle carries two crosspieces 58 and 60 which are tubular and stacked one above the other so as to line up with the apertures in the ears 46 when handle end 54 is transversely aligned with the latter as shown in full lines. When using the unit 10 in the dry or dusting mode, handle 44 is fixed relative to the frame (full line position) by passing bolts 48 and 50 through both tubular crosspieces 58 and 60 as well as the pairs of apertures in the ears aligned therewith. In such an attitude, the unit will normally be tilted to the rear toward the operator bringing the portion of web 20 stretched between the pressure roller and supply roller subassemblies into contact with the lane surface. When wet cleaning the lane, on the other hand, applicant has found it important to allow the assembly in engagement with the lane surface to freely pivot or "float" so to speak relative to the handle upon which much greater pressure is being brought to bear than in a simple dry dusting operation. The unit of the present invention accomplishes this desirable end efficiently and easily by merely removing one of the handle attachment bolts (preferably upper bolt 50) from its crosspiece 60 and permitting the handle to pivot freely about the other as shown in phantom lines. When this is done, the unit will rock forward under the influence of forwardy-directed handle pressure applied therebehind thus maintaining the span of web 20 between the pressure roller and take-up roller subassemblies in constant uniform broad-area contact with the lane surface thus more effectively cleaning the latter.

In most respects, the means by which the take-up and supply rollers 40 and 42 are detachably mounted between the sideplates of the frame are identical as well as the structures of the rollers themselves. Both rollers comprise tubular members having a plug 62 at one end with an outwardly-facing diametrical slot 64 therein, these features having been shown on the left end of the supply roller 42. The same features, however, are present on the right-hand end of the take-up roller 40. Slotted plug 62 is received within a pocket 66 within socket member 68 fastened to the left sideplate 24L for rotational movement relative thereby by bolt and nut fastener subassembly 70. Inside pocket 66 in socket 68 extending diametrically thereacross is a pin 72 which, when seated in the slot 64 in the plug releasably lock the two together for conjoint rotation. Again, this same pin-and-slot interlock is provided on the right-hand end of the take-up roller 40 although it has not been specifically illustrated.

The right-hand end of the supply roller 42 and the left-hand end of the take-up roller 40 are, in the particular form shown, open and adapted to releasably receive a spring-biased plug subassembly that has been designated in a general way by reference numeral 74. A bolt 76 extends through an aperture in the endplate onto the inside thereof where a hollow stubshaft 78 is mounted thereon. The outer end of this stubshaft includes an annular abutment 80 that defines a stop for the outer end of compression spring 82. A plug element 84 is sized to fit into the open end of the take-up roller 40 as shown on the left end thereof in FIG. 1. The same arrangement is provided on the right-hand end of the supply roller 42. Plug 84 is marginally-flanged as shown at 86 to limit its insertion into the tube end. The plug also has a tubular hub 88 adapted to telescopically receive the stubshaft 78 and, at the same time form an abutment for the inner end of spring 82. A nut 90 on the end of bolt 76 engages the inside of the plug hub and holds the parts in assembled relation. By pulling plug 84 outwardly against the bias exerted thereon by spring 82, it will ride out on the stubshaft and thus back off far enough for insertion into the open roller shaft end when the opposite plugged end thereof is seated in its socket 68.

Now, with reference to FIG. 1, it can be seen that a friction disk 92 has been interposed between the socket member 68 on the left end of the supply roller 42 and the opposed inside face of left endplate 24L. By tightening nut and bolt fastener subassembly 70 to draw the socket out more tightly against the inside face of the friction disk, the resistance to turning the supply roller can be increased so as to keep the web taut.

Finally with reference once more to both FIGS. 1 and 2, it can be seen that socket 68M on the right-hand end of the take-up roller has been modified to include ratchet-receiving detents 94 spaced around the periphery thereof. Mounted in side right endplate 24R is a socketed member 96 having a blind bore 98 therein which carries a compression spring 100 in the bottom biasing a pin 102 outwardly into one of the detents in the periphery of the socket 68M thus preventing clockwise rotation thereof as seen in FIG. 2 which would allow the web to unroll while, at the same time, allowing it to be rotated counterclockwise. The latter function is accomplished by turning knob 104 fastened to the end of slightly modified nut and bolt subassembly 70M.

What is claimed is:

1. In a manually-operated bowling lane cleaning apparatus of the type having a frame made up of sideplates held spaced apart to span the lane by a crossframe structure, supply and take-up rollers journalled for rotation in longitudinally-spaced parallel relation fore and aft within the crossframe structure, a pressure roller disposed between and beneath the supply and take-up rollers paralleling the latter, a handle attached to the frame for pushing same along the lane, a web of fabric reaved from the supply roller underneath the pressure roller and onto the take-up roller, the pressure roller cooperating with one of the other rollers to maintain the section of fabric stretched therebetween in area contact with the lane surface, and front and rear pairs of wheels disposed at the outside corners of the frame, at least one pair of wheels being positioned to enter the ball gutters alongside the lane for keeping the pressure roller centered therebetween when the roll of fabric on one of the supply and take-up rollers is a size to lift the other pair free of the ball gutters, the improvement which comprises: tapering the pressure roller from the middle toward both ends and providing same with a compressible cushioned surface.

2. The improvements set forth in claim 1 wherein: sockets are mounted for rotation on at least one of the sideplates for receiving one end of one of the supply and take-up rollers for conjoint rotation; and, wherein axially-yieldable means is mounted for rotation in transversely-aligned relation to each of the sockets for receiving the other end of each roller, said means being operative upon axial displacement of the roller in the direction thereof to release said roller from the frame.

3. The improvement as set forth in claim 2 wherein: means comprising a friction clutch is interposed between one of said sockets and the sideplate to which it is connected, said clutch being operative upon actuation to vary the torque required to rotate the roller associated therewith.

4. The improvement as set forth in claim 3 wherein: the other of said sockets has a cylindrical surface shaped to form angularly-spaced ratchet teeth, and wherein a spring-biased pawl is carried by the adjacent sideplate in position to engage said ratchet teeth and cooperate therewith to permit rotation of the associated roller in one direction while preventing rotation in the opposite direction.

5. The improvement as set forth in claim 2 wherein: the axially-yieldable means comprise an axle fastened to the sideplate, plug-forming means for attachment to the end of one of the rollers mounted for axial movement along the axle, and spring means positioned on the axle between the sideplate and plug normally biasing the latter into engagement with the shaft end.

6. The improvement as set forth in claim 1 which includes: a pair of transversely-spaced upstanding ears are provided atop the crossframe structure midway between the ends thereof; a rigid handle having one end for connection to the frame; means comprising a first and second crossframe elements depending from said one end of said handle arranged in vertically-spaced relation to one another and sized for insertion between the ears; and, first and second connecting means for detachably connecting said handle to the frame, one of said first and second connecting means cooperating with one of said first and second crossframe elements to pivotally connect said handle between said ears so as to permit said frame to tilt to and fro relative thereto, and the other of said connecting means and the remaining crossframe element cooperating with one another and with the ears when connected thereto to freeze the aforesaid pivotal connection.

7. The improvement as set forth in claim 6 wherein the handle has a dogleg shape.

8. The improvement as set forth in claim 6 wherein: the crossframe members comprise tubes disposed one above the other at right angles to the handle and extending transversely of the frame, the ears include two transversely-spaced pairs of apertures arranged one above the other and wherein said connecting means comprise fasteners passing between the transversely-aligned apertures and through the tubes.

* * * * *